US007499011B1

(12) United States Patent
Perreault et al.

(10) Patent No.: US 7,499,011 B1
(45) Date of Patent: Mar. 3, 2009

(54) RESPONSE TIME COMPENSATION USING DISPLAY ELEMENT MODELING

(75) Inventors: William G. Perreault, Cedar Rapids, IA (US); Rick J. Johnson, Shellsburg, IA (US); Donald E. Mosier, Cedar Rapids, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 691 days.

(21) Appl. No.: 11/134,919

(22) Filed: May 23, 2005

(51) Int. Cl.
*G09G 3/36* (2006.01)

(52) U.S. Cl. ..... 345/89; 345/77; 345/78; 345/63; 345/211; 345/204; 345/690; 315/169.3

(58) Field of Classification Search ..... 345/87, 345/89, 63, 77, 147–149, 690–693, 204
See application file for complete search history.

(56) References Cited

U.S. PATENT DOCUMENTS 5,347,294 A * 9/1994 Usui et al. ..... 345/89
5,465,102 A * 11/1995 Usui et al. ..... 345/89
6,778,160 B2 * 8/2004 Kubota et al. ..... 345/89
2004/0090407 A1 * 5/2004 Park et al. ..... 345/87
2004/0246220 A1 * 12/2004 Cheon ..... 345/89

* cited by examiner

*Primary Examiner*—My-Chau T Tran
*Assistant Examiner*—Jennifer T Nguyen

(57) ABSTRACT

A method of improving response time of a display element in a display is disclosed. According to the method, a command input is provided that represents a desired response of the display element. The command input is modified, using a compensation function, to produce a command output to be sent to the display element. The compensation function uses the command input and a modeled luminance of the display element in a present state and at least one previous state to compute the command output. The command output is transmitted to the display element.

16 Claims, 4 Drawing Sheets

RESPONSE TIME COMPENSATION USING DISPLAY ELEMENT MODELING

FIELD OF THE INVENTION

The invention relates to displays, and more particularly, to the improvement of response times of displays.

BACKGROUND OF THE INVENTION

Liquid Crystal Displays (LCDs) have been used for many years to display both static and dynamic images, including video. Unlike displays based upon cathode-ray tube (CRT) technology that has nearly instantaneous pulse-type display characteristics, LCDs provide significantly slower response times. Slow response times can result in visible distortion of dynamic images, particularly when the dynamic portion of the images include rapid movement. Some newer types of LCDs have significantly slower inherent response times, which make this problem more visible and problematic, even at relatively slow rates of image movement. The slow response times create visible distortions such as smearing or dimming, and can make moving symbology essentially unusable.

Significant effort has been made to correct for this slow response time by including response time correction or compensation circuitry in the display control hardware. All known prior attempts have included circuitry to provide a modified LCD command through analyzing previous commands to detect luminance changes, and applying a larger LCD command signal to force the display response to be faster. One solution has involved inserting a finite impulse response filter (FIR) 10 in the command stream, as shown schematically in FIG. 1. FIR filter 10 includes a function $f_{FIR}(\ )$ having as inputs current and previous values of x(n), which is the desired luminance or gray scale for a single display element (a red, green, or blue portion of a display pixel). The output of function $f_{FIR}(\ )$ is y(n), which is the commanded luminance sent to the display. If function $f_{FIR}(\ )$ is linear, the circuit characterized by FIR filter 10 is linear as well and is characterized by the following linear difference equation:

$$y(n) = \sum_{r=0}^{M} b_r x(n-r) \qquad \text{(Equation 1)}$$

In Equation 1, M is the number of previous commands to be used in the circuit, and $b_r$ is a weighting coefficient for each command to be used. If function $f_{FIR}(\ )$ is nonlinear, the circuit characterized by FIR filter 10 is also nonlinear and is characterized by the following equation:

$$y(n)=f(x(n), x(n-1), \ldots, x(n-M)) \qquad \text{(Equation 2)}$$

If sufficient delay elements are included, as represented by a large value for M, a relatively good history of past desired luminance values is available to determine a command which will create the desired luminance in a short time.

In practice, the delay elements are implemented as banks of memory (RAM), and a memory storage device is required for each display element in a display. Thus, an XGA display will require 1024×768×3 memory locations for each delay element. The width of memory for each memory location is ideally the same as the LCD gray scale control, typically 6 or 8 bits. Thus, a single delay element comprises a memory array of 2.359 Megabytes.

Because of the large number of memory locations required, there has been an effort to determine effective ways to reduce either the number of delay stages or the width of each memory location. Reducing the number of bits stored for each display element reduces output fidelity. Reducing the number of delay elements reduces the ability to select an appropriate command. Most practical implementations include only one or two delay stages, but such a limited number of delay stages or elements in a FIR filter limits the effectiveness of the filter. Methods have also been described to reduce memory width. While such methods have been proven reasonably adequate for low fidelity television images, they have been less successful in providing the high quality dynamic images provided for avionics situational or tactical displays.

FIG. 2 is a graph showing a command value or signal x(n) that calls for an increase in luminance at the beginning of time frame 1. The response time of an uncompensated signal is shown at 22, and the response time of a signal that is compensated using the FIR filter function $f_{FIR}(\ )$ is shown at 24. It can be seen that the compensated response approaches the command signal x(n) much faster than the uncompensated signal 22. The decrease in response time is due to the increased filtered command value y(n) between time frame 1 and time frame 2.

A shortcoming of FIR filter 10 is that only current and previous input command values x(n) are used for computing an output command value y(n). FIR filter 10 does not take into account previous output command values y(n). Further, there is no accommodation for how the LCD display element is actually responding to the command values transmitted thereto. Unfortunately, it is very difficult to determine the output of a single display element in a large LCD array.

It is therefore an object of the invention to improve the response time of display elements used in an LCD display or the like.

It is a further object of the invention to reduce the number of delays required in a circuit for improving the response time of a display element.

It is another object of the invention to reduce the amount of memory required in a circuit for improving the response time of a display element.

A feature of the invention is modeling how a display element responds to a display command, and modifying the display command based upon the modeled response.

An advantage of the invention is an improved display element response time using a minimum amount of memory space.

SUMMARY OF THE INVENTION

The invention provides a method of improving response time of a display element in a display. According to the method, a command input is provided that represents a desired response of the display element. The command input is modified, using a compensation function, to produce a command output to be sent to the display element. The compensation function uses the command input and a modeled luminance of the display element in a present state and at least one previous state to compute the command output. The command output is transmitted to the display element.

The invention also provides a method of adjusting a luminance command to a display element in a liquid crystal display. According to the method, the luminance command is modified, using a compensation function, to produce a current command output to be sent to the display element. The compensation function uses the command input and at least one previous command output to compute the current command output. The current command output is transmitted to the display element.

The invention further provides a control system for a display. The control system includes a compensator configured to adjust a luminance command to a display element in the display to improve the response time of the display element. The compensator adjusts the luminance command based upon the luminance command, a current modeled luminance of the display element and a previous modeled luminance of the display element.

DETAILED DESCRIPTION OF THE DRAWINGS

Figure 1:
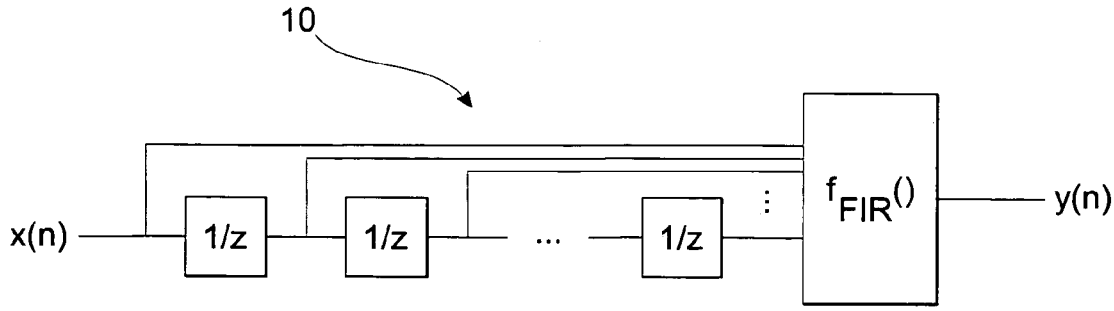
FIG. 1 (PRIOR ART)
FIG. 1 is a schematic diagram of a known finite impulse response (FIR) filter.
Figure 2:
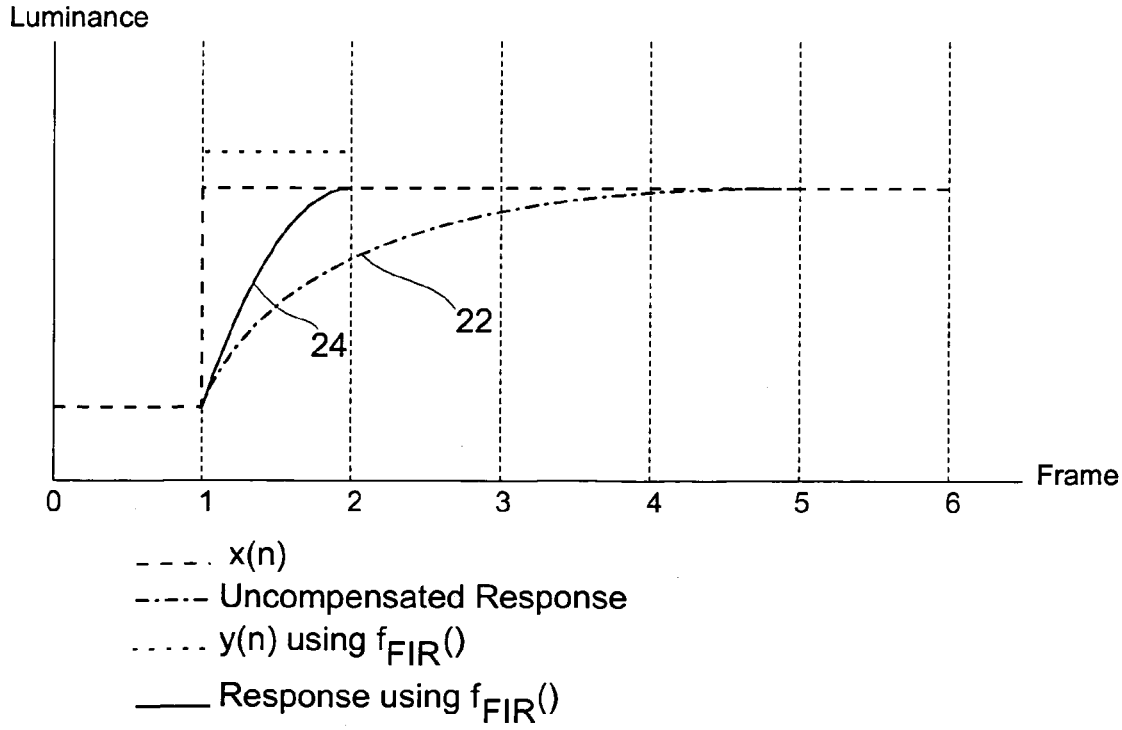
FIG. 2 (PRIOR ART)
FIG. 2 is a graph comparing display element response times for uncompensated and compensated command values.
Figure 3:
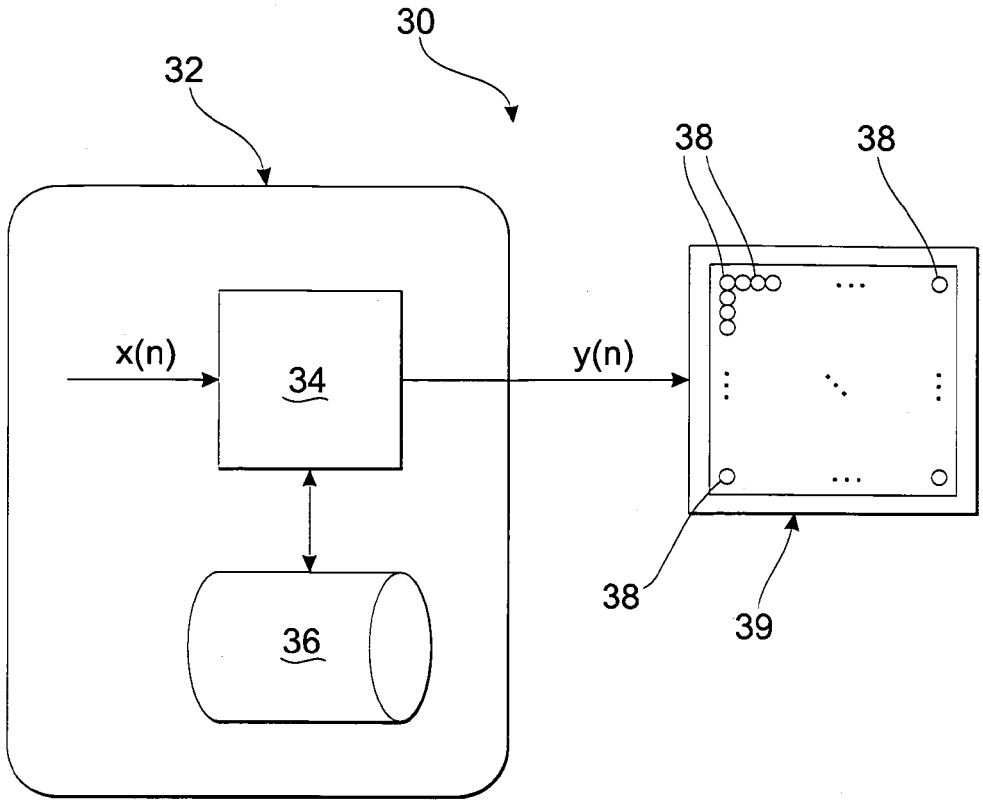
FIG. 3 is a schematic diagram of a control system that implements the invention.

A system for displaying images on a display is schematically shown in FIG. 3 and generally indicated by reference number 30. System 30 includes a processor 32 having a processing element 34, which may be one of many processing elements within processor. Alternatively, processing element 34 may represent a portion of a single processor. Processing element 34 is operationally connected to a data storage element 36. Data storage element 36 is preferably a random-access memory (RAM) device or another re-writable, fast access memory device. Data storage element 36 is sufficiently large to store previous luminance commands as well as current and previous modeled luminance information for each display element, as will be further described herein. Processing element 34 also receives, as an input, a desired display element luminance command x(n). Processing element 34 transmits a luminance output command y(n) to a display element 38 forming part of an LCD display 39. In a preferred embodiment each display element is a red, green or blue portion of a single LCD pixel of LCD display 39. The luminance output command y(n) increases, decreases, or maintains the luminance of a given display element until another luminance output command y(n) is sent to the display element.

Figure 4:
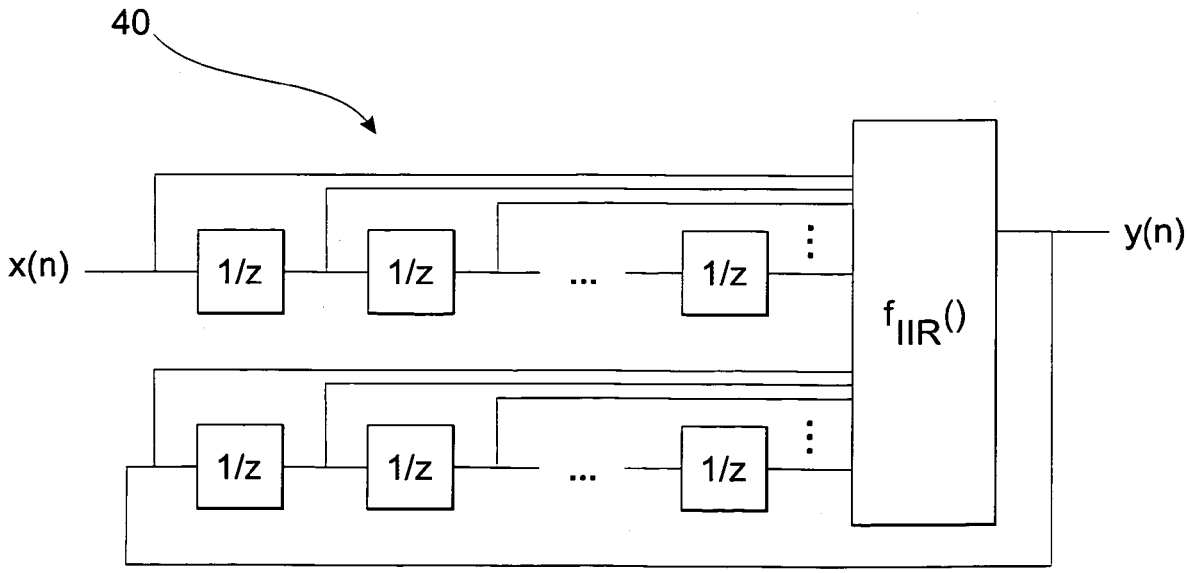
FIG. 4 is a schematic diagram of an infinite impulse response (IIR) filter according to the invention.

System 30 is exemplary of a system that may be used to improve LCD response times in a display such as an avionics display. FIG. 4 schematically depicts an infinite impulse response (IIR) filter 40. As before, x(n) is the desired current luminance or gray scale for a single display element and y(n) is the commanded luminance command sent to the display. If function $f_{IIR}(\ )$ is linear, the circuit characterized by IIR filter 40 is linear and is characterized by the following linear difference equation:

$$y(n) = \sum_{r=0}^{M} b_r x(n-r) + \sum_{k=1}^{N} a_k y(n-k) \qquad \text{(Equation 3)}$$

In Equation 3, M is the number of previous input commands x(n) to be used in the circuit, N is the number of previous output commands y(n) to be used in the circuit, and $b_r$ and $a_k$ are weighting coefficients for each command to be used. If function $f_{IIR}(\ )$ is nonlinear, the circuit characterized by IIR filter 40 is also nonlinear and is characterized by the following equation:

$$y(n)=f(x(n), x(n-1), \ldots, x(n-M), y(n-1), y(n-2), \ldots, y(n-N)) \qquad \text{(Equation 4)}$$

Because of the infinite impulse response of this circuit type, inputs have an effect for more and more time. Thus, it may be possible to reduce memory storage by eliminating the delay elements entirely for the input commands x(n), and using only one or two delay elements for the output commands y(n).

Figure 5:
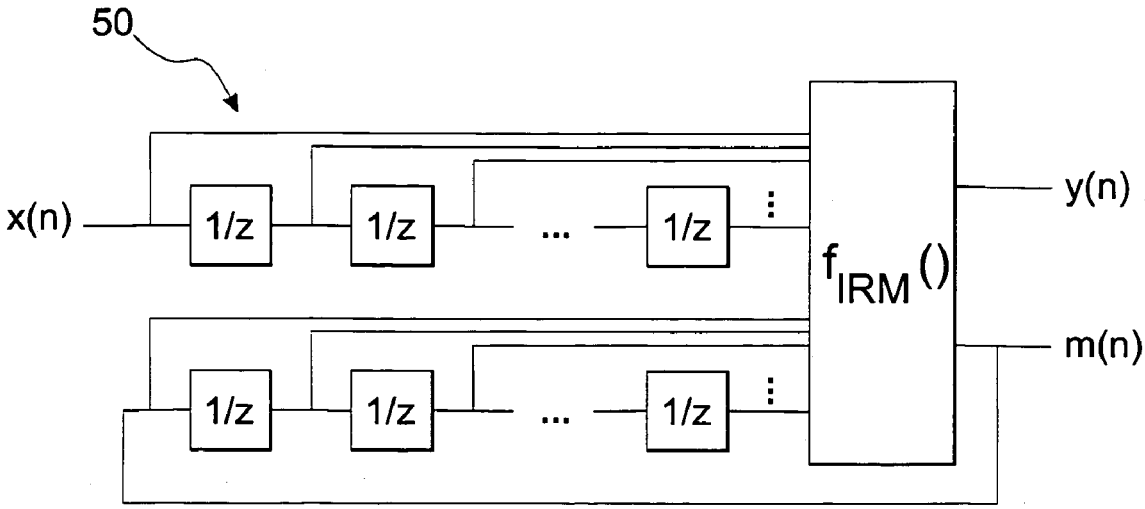
FIG. 5 is a schematic diagram of an infinite impulse response filter using LCD modeling (IRM) according to the invention.

As previously noted, prior attempts to improve response times of LCD display elements have not used compensation algorithms that incorporate knowledge of how the LCD is actually responding. Because of the difficulty of determining the actual response of each display element independent of all display elements in a display (which in an XGA display totals 1024×768×3 colors=2,359,296), a model of the LCD display element response may be used as an effective alternative. FIG. 5 depicts a circuit of a modified IIR (IRM) filter 50 that incorporates a modeled state function m(n) of the response of the LCD display element to determine the luminance command to be sent thereto. In this circuit, x(n) and y(n) are as previously defined, while m(n) is a modeled or computed LCD state based on the previous desired states, the current command, and the previously modeled LCD states. For a linear modified compensation function $f_{IRM}$ the corresponding equations are:

$$y(n) = \sum_{r=0}^{M} b_r x(n-r) + \sum_{k=0}^{N} a_k m(n-k) \qquad \text{(Equation 5a)}$$

and $$m(n) = \sum_{r=0}^{M} c_r x(n-r) + \sum_{k=1}^{N} d_k m(n-k) \qquad \text{(Equation 5b)}$$

A more generalized set of equations, which would incorporate both linear and non-linear modified compensation functions $f_{IRM}$, are:

$$y(n)=f_{IRM1}(x(n), x(n-1), \ldots, x(n-M), m(n), m(n-1), \ldots, m(n-N)) \qquad \text{(Equation 6a)}$$

$$m(n)=f_{IRM2}(x(n), x(n-1), \ldots, x(n-M), m(n-1), m(n-2), \ldots, m(n-N), y(n)) \qquad \text{(Equation 6b)}$$

In its simplest form, the modeled LCD display element state m(n) is simply the computed luminance of the corresponding display element. The computed luminance may be determined by empirically sampling an individual display element in a laboratory or pre-implementation environment and determining the response of the display element in different command scenarios. For example, the empirical sampling can test the response of a display element based on (a) the luminance in a current or previous state, and (b) the desired change in luminance. It can be assumed that the display element will respond similarly or proportionately during normal operation as it did during empirical testing. The modeled state function m(n) takes into account the empirical sampling of the above situations when creating the modeled state function m(n) and the modified infinite response compensation function $f_{IRM}(\ )$.

Figure 6:
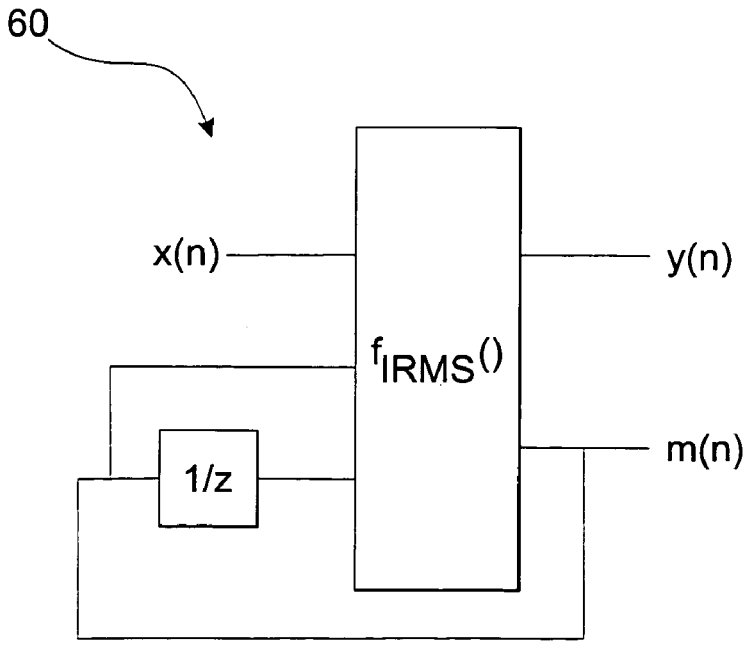
FIG. 6 is a schematic diagram of a simplified IRM (IRMS) filter according to another embodiment of the invention.

The IRM filter 50 shown in FIG. 5 effectively incorporates a modeled or computed response of an LCD display element. However, significant memory space is required to store previous input commands x(n) and modeled state functions m(n). It is possible, though, to reduce the number of previous input commands and modeled state functions required to be stored by including additional display element state information in the modeled state function m(n). Such additional display element state information may include dynamic characteristics of the display such as (a) whether the luminance of the display element is moving or static, and/or (b) the rate of change of the luminance. The state information is preferably expressed as additional bits in the modeled state function m(n). If the state information is so included, the number of delay elements and corresponding memory requirements may be further reduced without significant impact to display quality. FIG. 6 depicts an exemplary simplified IRM (IRMS) compensation function 60 that uses only one delay element for the modeled state function m(n) and uses no delay elements for the input command function x(n).

For a linear IRMS compensation function $f_{IRMS}$ the corresponding equations are:

$$y(n)=b_0x(n)+a_0m(n)=a_1m(n-1) \quad \text{(Equation 7a)}$$

and $$m(n)=c_0x(n)+d_0m(n)=d_1m(n-1) \quad \text{(Equation 7b)}$$

For a non-linear IRMS compensation function $f_{IRMS}$ the corresponding equations are:

$$y(n)=f_1(x(n),m(n),m(n-1)) \quad \text{(Equation 8a)}$$

and $$m(n)=f_2(x(n),m(n),m(n-1)) \quad \text{(Equation 8b)}$$

Figure 7:
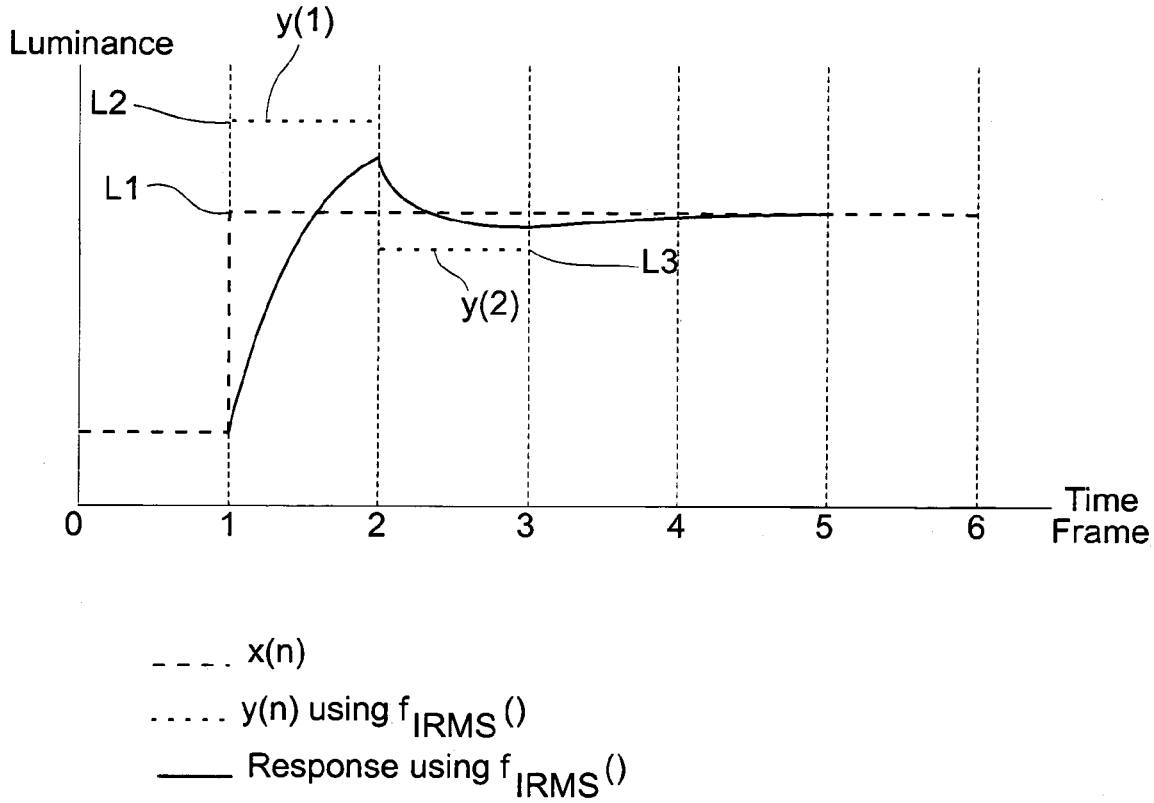
FIG. 7 is a graph showing a possible response time of the invented IRMS filter.

FIG. 7 is a graph showing the improvement in response time using the invented IRMS filter 60. An input command x(n) calls for an increase in luminance to level L1 at the beginning of time frame 1. The IRMS compensation function $f_{IRMS}(\ )$, using the modeled state function m(n) as previously described, outputs a command signal y(1) that directs the response to overshoot, to luminance level L2, the desired luminance level L1 during time frame 1. At time frame 2, the IRMS filter function $f_{IRMS}(\ )$ outputs a command signal y(2) that directs the response to decrease luminance output to level L3. Using this process, the luminance of the specific display element is integrated over time to average out to the luminance level L1. The invented IRMS filter function therefore improves response time over known processes. Although there is some overshoot of the target luminance level when application of $f_{IRMS}(\ )$ is designed to deliver an overcompensated luminance command as depicted in FIG. 7, the target luminance level is initially achieved much faster than when using known processes. The improvement in response time may even be sufficient to reproduce the pulse response of a CRT display.

The IRM and IRMS filtering approach to response time compensation may also be described in control system terms. In the control system realm, IRM filter 50 and IRMS filter 60 would be considered observer compensators. Briefly stated, the state of the display element is estimated and is used as the feedback in the controller.

Although FIG. 7 depicts the invention providing an overcompensated or overshooting response, according to the invention the compensation functions $f_{IIR}(\ )$, $f_{IRM}(\ )$ and $f_{IRMS}(\ )$ may be designed or employed to provide any desired type of response, such as critically damped, undercompensated, linear, or non-linear responses. The compensation functions may even be employed to effect a time-delayed response where a small compensation command in a first time frame is followed by a large compensation command in the next time frame.

The invention may be varied in many ways while keeping with the spirit and scope of the invention. For example, the modeled state function m(n) and the modified infinite impulse response compensation functions $f_{IRM}(\ )$ and $f_{IRMS}(\ )$ may be derived using other empirically obtained data on the display element, or may also be derived using estimated, interpolated or extrapolated response data relating to the display element. The circuits in the various figures are representative of hardware designs, software-based algorithms, or any suitable combination thereof. The display elements have been described as being part of an LCD display, but the invention may also be used with other types of displays that could benefit from improved display element response times.

An advantage of the invention is that modeling the response of a display element provides a more accurate display element command.

Another advantage is that because the luminance quickly rises to the desired luminance level and is then dynamically adjusted to converge to the desired luminance level, the invention provides a noticeably faster response time when compared to known compensation algorithms.

Still another advantage is that modeling the display element response permits a compensator design using a minimum number of delay elements. This results in a significant decrease in memory and computational requirements, which in turn results in faster processing time.

Yet another advantage is that the invention may be instantiated in circuitry, in software, or in any advantageous combination of circuitry or software.

While the invention has been disclosed in its preferred form, the specific embodiments thereof as disclosed and illustrated herein are not to be considered in a limiting sense as numerous variations are possible. The subject matter of the invention includes all novel and non-obvious combinations and subcombinations of the various elements, features, functions and/or properties disclosed herein. No single feature, function, element or property of the disclosed embodiments is essential to all of the disclosed inventions. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower or equal in scope to the original claims, are also regarded as included within the subject matter of the invention of the present disclosure.

What is claimed is:

1. A method of improving response time of a display element in a display, the method comprising:

providing a command input that represents a desired response of the display element;

modifying the command input, using a compensation function, to produce a command output to be sent to the display element, wherein the compensation function uses the command input and a modeled luminance of the display element in a present state and at least one previous state to compute the command output; and transmitting the command output to the display element;

wherein the compensation function is of a form $$y(n)=f(x(n), x(n-1), \ldots, x(n-M), m(n), m(n-1), \ldots, m(n-N))$$

where x(n) is a current command input, M is a number of previous command inputs used to adjust the current command input, y(n) is the command output, and m(n) is the current modeled luminance of the display element and is computed using a function of a form $$m(n)=f(x(n), x(n-1), \ldots, x(n-M), m(n-1), m(n-2), \ldots, m(n-N), y(n))$$

where N is a number of previous states of modeled luminances used to adjust the current command input.

2. The method of claim 1, wherein the compensation function further uses the command input in at least one previous state to compute the command output.

3. The method of claim 1, wherein the modeled luminance is computed by calculating a present state of the display element, the present state of the display element being based upon a previous state and a desired future state of the display element.

4. The method of claim 3, wherein the modeled luminance of the display element is further computed using dynamic characteristics of the display element.

5. The method of claim 4, wherein the dynamic characteristics of the display element include at least one of a rate of change of a luminance of the display element, and a direction of change of the luminance of the display element.

6. The method of claim 1, wherein the modeled state is empirically derived from known response characteristics of the display element.

7. The method of claim 1, wherein M=0 and N=1.

8. The method of claim 1, wherein the compensation function modifies the command input such that the command input overshoots the desired response of the display element.

9. A method of adjusting a luminance command to a display element in a liquid crystal display, comprising:

modifying the luminance command, using a compensation function, to produce a current command output to be sent to the display element, wherein the compensation function uses the command input and at least one previous command output to compute the current command output; and transmitting the current command output to the display element;

wherein the compensation function further uses the command input in at least one previous state to compute the current command output; and wherein the compensation function is of a form $$y(n)=f(x(n), x(n-1), \ldots, x(n-M), y(n-1), y(n-2), \ldots, y(n-N))$$

where x(n) is a current command input, M is a number of previous command inputs used to adjust the current command input, y(n) is the current command output, and N is a number of previous command outputs used to compute the command output.

10. The method of claim 9, wherein M=0 and N=1.

11. A control system for a display, comprising:

A compensator configured to adjust a luminance command to a display element in the display to improve the response time of the display element, the compensator adjusting the luminance command based upon the luminance command, a current modeled luminance of the display element and a previous modeled luminance of the display element;

wherein the luminance command adjustment is accomplished using functions of a form $$y(n)=f(x(n), x(n-1), \ldots, x(n-M), m(n), m(n-1), \ldots, m(n-N))$$

and $$m(n)=f(x(n), x(n-1), \ldots, x(n-M), m(n-1), m(n-2), \ldots, m(n-N), y(n))$$

where x(n) is a current luminance command, M is a number of previous luminance commands used to adjust the current luminance command, y(n) is the adjusted luminance command, m(n) is the current modeled luminance of the display element and N is a number of previous modeled luminances used to adjust the current luminance command.

12. The control system of claim 11, wherein the luminance command adjustment is further based upon at least one previous luminance command.

13. The control system of claim 11, further comprising a memory to store data representative of the previous modeled luminance.

14. The control system of claim 11, wherein the luminance command adjustment is further based upon modeled luminances at a plurality of previous times.

15. The control system of claim 11, wherein the modeled luminance is a function of a previous state and a desired future state of the display element.

16. The control system of claim 11, wherein the compensator comprises a processor, the processor being operationally connected to the display element.

* * * * *